United States Patent [19]

Moss et al.

[11] Patent Number: 4,702,582

[45] Date of Patent: Oct. 27, 1987

[54] PROCESSING DEVICE

[75] Inventors: Brian F. Moss, Chelford; Richard J. Brent, Handforth, both of England

[73] Assignee: Ciba-Geigy AG, Basel, Switzerland

[21] Appl. No.: 877,955

[22] Filed: Jun. 24, 1986

[30] Foreign Application Priority Data

Jun. 25, 1985 [GB] United Kingdom ..... 8516057

[51] Int. Cl.[4] ..... G03D 13/06

[52] U.S. Cl. ..... 354/331; 354/313; 354/329

[58] Field of Search ..... 354/310, 312, 313, 314, 354/316, 323, 328, 329, 330, 331, 335, 337

[56] References Cited

U.S. PATENT DOCUMENTS

| | | | |
|---|---|---|---|
| 2,344,998 | 3/1944 | Morgan et al. | 354/328 |
| 4,001,857 | 1/1977 | Ikechi et al. | 354/337 |
| 4,134,666 | 1/1979 | Kikuchi | 354/313 |
| 4,429,981 | 2/1984 | Frazier | 354/328 |
| 4,514,070 | 4/1985 | Norris | 354/313 |
| 4,586,803 | 5/1986 | Moss et al. | 354/329 |

*Primary Examiner*—A. A. Mathews

*Attorney, Agent, or Firm*—Harry Falber

[57] ABSTRACT

A film-processing device comprises a lid having mounted therein a plunger or the like, which plunger is required to be rotatable in either direction in the lid and which is also required to be locked stationary in the lid. The plunger is connected with a cap which fits over the lid and which rotates with the plunger. The cap has a slidable member mounted thereon or therein with at least one detent member mounted on its underside so that, in one position of the slidable member, the cap is able to rotate on the lid, but in another position of the slidable member, the detent member thereon acts with an abutment member or members on the lid to disable the cap from rotating on the lid.

7 Claims, 7 Drawing Figures

PROCESSING DEVICE

BACKGROUND OF THE INVENTION

This invention relates to improvements in a processing device which comprises: a lid, a plunger or other elongated member mounted in the lid in a manner such that, when the device is in use, the plunger can either be fixed in the lid, or the plunger can be rotated in either direction within the lid, while the lid remains stationary.

A developing device in which a plunger can be rotated in either direction by means of a radially extending arm serving as a handle and having a rotatable grip at its free end, while a cover member or lid remains stationary, has been described in U.S. Pat. No. 4,001,857 to Masai Ikechi et al, assigned to Fuji Photo Film Co., Ltd. However, the handle and the grip thereon protrude at all times from the upper end of the device and must be removed therefrom if unintentional rotation is to be avoided.

OBJECTS AND SUMMARY OF THE INVENTION

It is therefore an object of the invention to provide an improved processing device of the initially described type in which means for rotating the plunger therein cannot be rotated unintentionally.

It is another object of the invention to so improve the initially described device that a rotatable plunger therein can be locked in position in the lid of the device so that the plunger can perform the function of piercing an object such as a container filled with processing liquid, whereupon the liquid can be stirred when the plunger is in rotatable position.

These objects are achieved, in accordance with the present invention, in a device of the above-described type in which the plunger can be rotated, in a first position, in either direction, or, in another position, it can be locked stationary in the lid of the device, and which device is improved by comprising, in combination, plunger-actuating means comprising a cap which fits over the lid and to which the plunger is connected and which rotates with the plunger, cap-securing means for securing the cap on the lid, the said cap having a slidable member mounted thereon or therein with detent means comprising at least one detent member mounted on its underside so that, in one position of the slidable member, the cap is able to rotate on the lid, while in another position of the slidable member, the detent member thereon acts with an abutment member or members on the lid to disable the cap from rotating on the lid.

Preferably, in one position, the slidable member fits into the cap so that it appears to be part of the cap, having its upper face flush with the top surface of the cap. Also, when the slidable member fits flush into the cap, the cap is preferably disabled from rotating relative to the lid but when the slidable member is slid out partially from the cap it can act as a handle by use of which the cap can be rotated on the lid in either direction. A handling knob, known per se, can be mounted on the upper surface of the slidable member.

In a preferred embodiment of the device, the plunger-actuating means comprise four members associated with the slidable member, two of which are detent members, which slide in four grooves in the cap and serve to secure the slidable member on the cap. Preferably, when the slidable member is in the position in which the cap cannot rotate, two of the detent members have been slid into a gap between two axially upwardly projecting members on the lid, thereby preventing rotation of the cap on the lid, and thus locking the plunger stationary relative to the lid. It is advantageous to provide four such axially upwardly projecting members on the lid, and the cap fits over these members so as to secure the cap to the lid.

The device of the present invention is of particular use when it is required that the plunger fixed in the lid performs a function such as piercing an object such as, for example, a container to free its contents and then, when it is rotating, stirs up the freed contents of the container.

In one particular embodiment a roll film cassette is mounted on the plunger. The slidable member is moved to the position in which it prevents the cap from rotating on the lid and thus the plunger from rotating independently of the lid. When the lid containing the plunger is screwed down onto a cassette body-retaining block stationary in a container, an end cap of the cassette is forced off the cassette by the action of the plunger locked in stationary position in the lid, but able to rotate with the lid. When the end cap has been forced off the cassette, a further upward screwing movement of the lid relative to the container forces the spool in the cassette having a roll of exposed film coiled thereon down into a liquid bath in the container below the cassette body-retaining block. When the film is in the liquid in the container it must be rotated almost continuously first in one direction and then in the other direction in order to ensure that the processing liquid covers evenly the entire surface of the film. Thus, when the film has been pushed down into the container by the plunger, with the spool still being attached to the plunger, the slidable member of the cap is pulled out laterally to serve as a handle by means of which the plunger can be rotated in either direction.

BRIEF DESCRIPTION OF THE DRAWINGS

Further objects and advantages of the invention will become apparent from the following more detailed description thereof in connection with the accompanying drawings in which.

DETAILED DESCRIPTION OF THE EMBODIMENT SHOWN IN THE DRAWINGS

Figure 1:
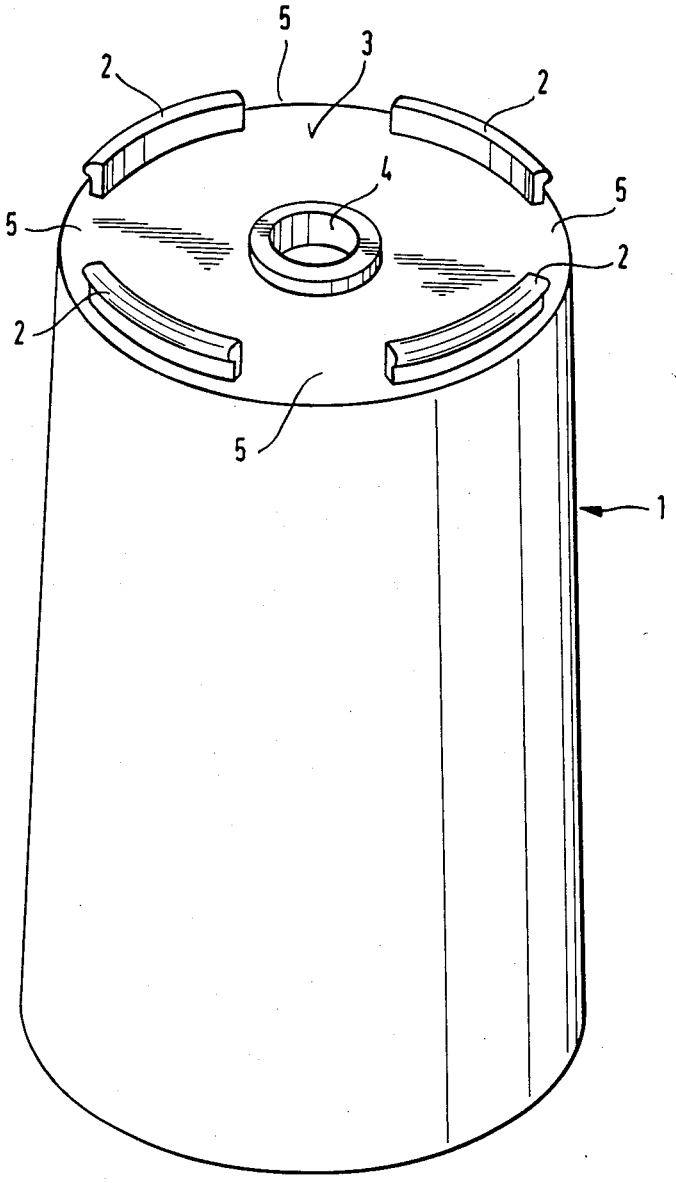
FIG. 1 is a perspective view of an embodiment of the improved lid according to the invention.
Figure 7:
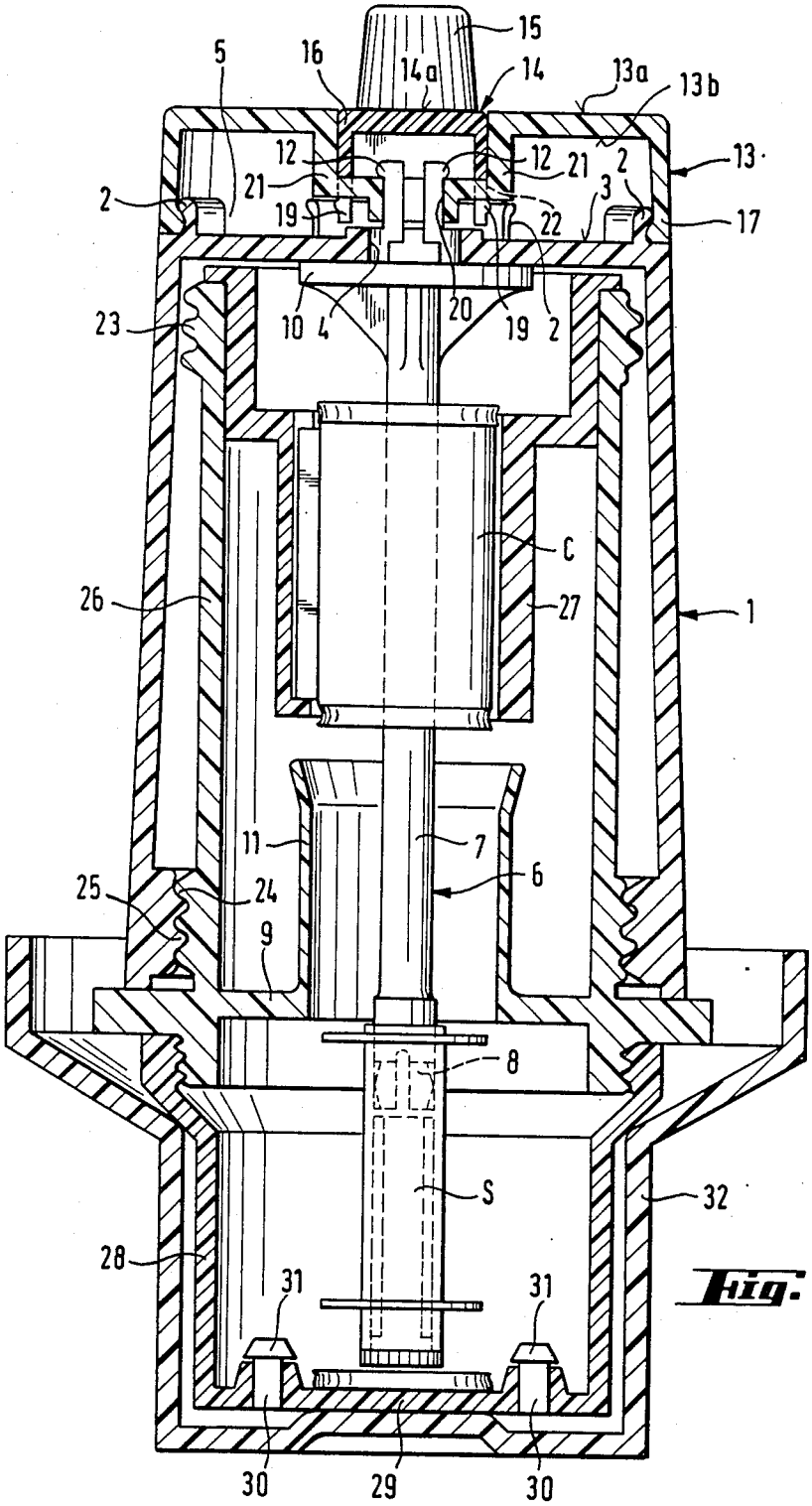
FIG. 7 is an axial sectional view of the assembled improved device according to the invention taken in a plane indicated by VII—VII in FIGS. 5 and 6.

In FIG. 1, there is shown an improved lid 1 being provided on its inside wall with an internal threading 25 (see FIG. 7). The lid bears on its top wall 3 four axially upwardly projecting cap-engaging members 2 arranged about the periphery of the lid top wall 3 with gaps 5 therebetween. The top wall 3 has a central opening 4 into which a plunger 6 fits.

Figure 2:
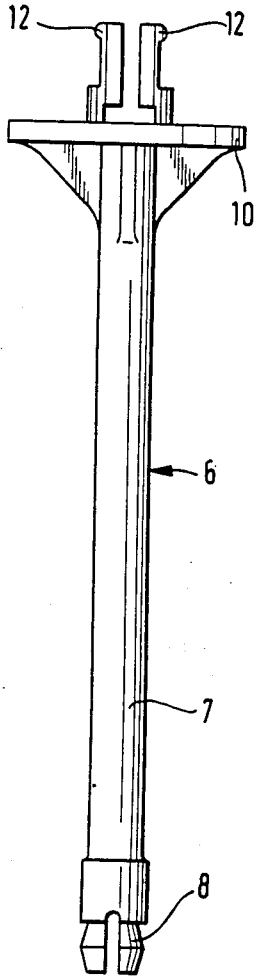
FIG. 2 is a lateral view of a plunger to be mounted in the improved lid.

In FIG. 2, this plunger 6 comprises an elongated shaft 7 terminating in a lower end 8 which is forked. At its upper end the shaft 7 bears a flat annular bearing flange 10, which when mounted in the lid 1 bears against the underface of the lid top wall 3 of the lid 1. Two resilient snap-in members 12 mounted on the upper surface of the annular flange 10 fit into a central elongated cavity or opening 20 of a cap 13 (see FIG. 5) to secure the plunger 6 to the cap 13 and ensure that the cap 13 and the plunger 6 must rotate together.

Figure 3:
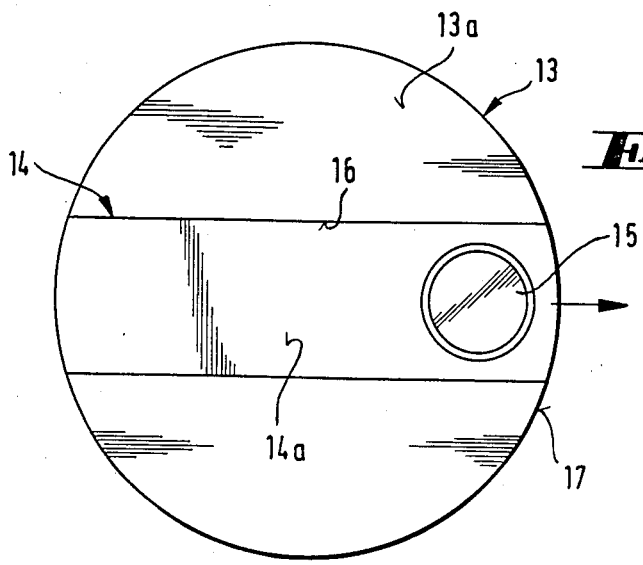
FIG. 3 is a top plan view of a cap which fits on the improved lid of FIG. 1, with a slidable member associated with the cap.

In FIG. 3 there is shown in top plan view the cap 13 which is destined to be press-fitted over the upwardly projecting cap-engaging members 2 on the lid 1 to secure the cap 13 on the lid 1. A slidable member 14 is lodged in a diagonally extending groove 16 of the cap 13 and can be partly slid out of the groove 16 in the cap 13 in the direction indicated by an arrow. A knurled knob 15 is mounted on the top surface 14*a* of the slidable member 14. Preferably, the top face 14*a* of the member 14 lies flush with the top end face 13*a* of the cap 13.

Figure 4:
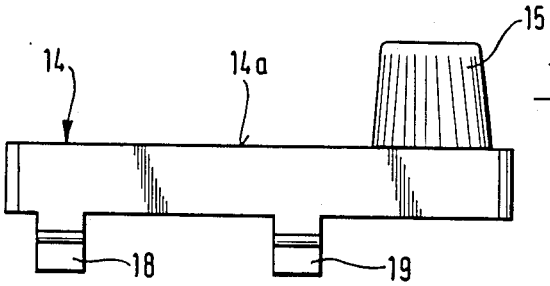
FIG. 4 is a lateral view of the slidable member removed from the cap.

The slidable member 14 with the knob 15 thereon is shown in FIG. 4 removed from the cap 13. On its underside the slidable member 14 has two pairs of detent members 18 and 19. Both pairs of detent members serve to secure the slidable member 14 in the groove 16 of the cap 13 as shown in FIG. 5.

On the underside 13*b* of the cap 13 there are provided in a downwardly projecting bar member 21 two pairs of elongated slots or grooves 22 into which the two pairs of members 18 and 19 on the slidable member 14 are respectively inserted to secure the slidable member 14 to the cap 13, while being free to slide longitudinally in these slots 22. An annular flange 17 depending axially downward from the periphery of the cap 13 fits over the upraised members 2 on to the top end face 3 of the lid 1 to secure the cap 13 with snap engagement on the lid 1.

Figure 5:
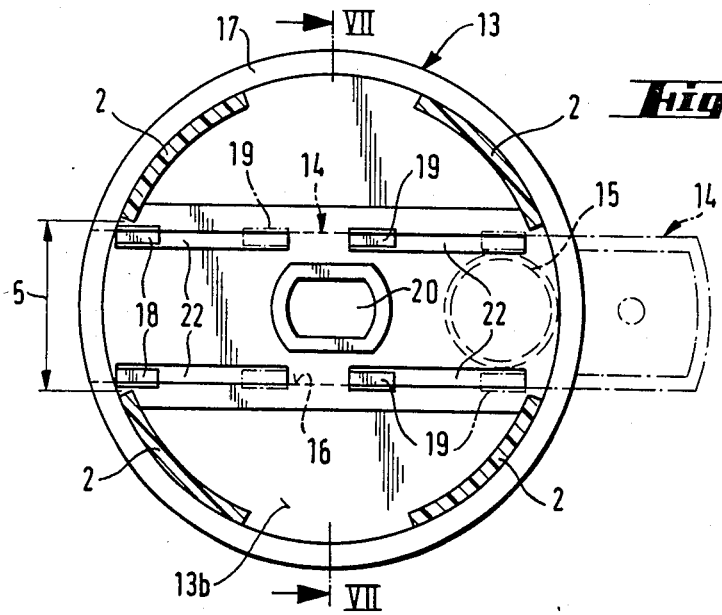
FIG. 5 is an underside plan view of the cap with the slidable member secured to it.

When the pairs of detent members 18 and 19 are slid to left, to the end position in their respective grooves 22 shown in FIG. 5, they are located in a gap 5 between two of the cap-engaging members 2 on the lid 1. In this end position, the cap 13 is prevented from rotating relative to the lid 1, but can be rotated together with the lid. When the pairs of members 18 and 19 are slid to the opposite end of their respective grooves 22, the cap 13 can rotate on the lid 1 as the detent members 19 are no longer located in a gap 5 between two cap-engaging members 2.

Figure 6:
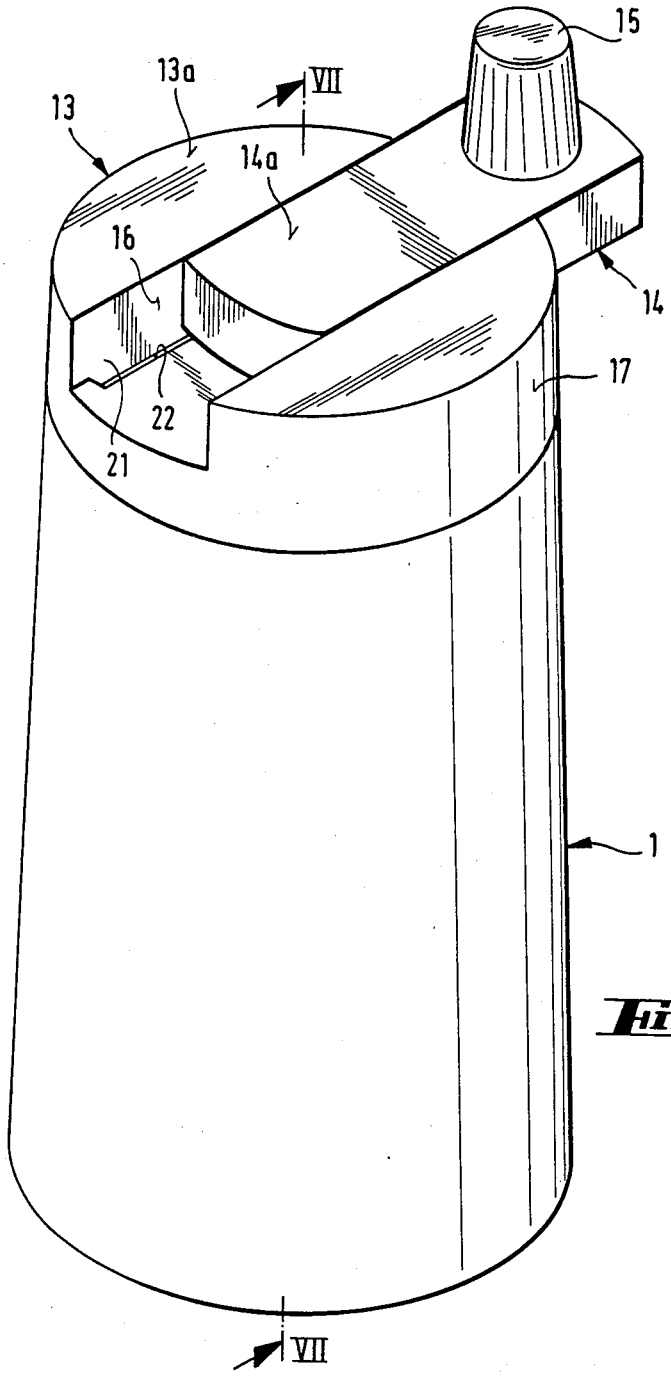
FIG. 6 is a perspective view of the lid and the cap assembled with the slidable member in plunger-rotating position.

In FIG. 6 the cap 13 is shown mounted on the lid 1. The slidable member 14 is partially displaced to the right relative to the cap 13 and can thus serve as a handle. The groove 16 in which the member 14 is slidably lodged as well as one of the slots 22 engaging the detent members 18 and 19 are visible in FIG. 6.

In FIG. 7 is shown a processing device which incorporates the lid 1 and the cap 13 and the remainder of the parts mentioned in the foregoing description of FIGS. 1 to 6. This device is a photographic film-processing container the operation of which is described in detail in European patent application No. 84 810560.7 filed on 19th Nov. 1984 and having the publication No. 147366.

In brief, the apparatus of FIG. 7 comprises in an assembly the lid 1, the cap 13, the handle 14 and the plunger 6 already described. The lid 1 is then screwed by means of its internal threading 25 onto an upper columnar casing 26 provided with an external threading 23 and containing a cassette body-retaining block 27.

A liquid container 28 is screwed onto the lower end of the upper container body 26. At the base 29 of the container 28 there are provided a number of holes 30 which are covered each by a light shield 31 and through which holes liquid can enter or leave the lower container 28. The container 28 has been shown stood in a beaker 32.

The bottom end 9 of the upper container 26 has an upwardly elongated, funnel-shaped part 11 serving to catch the lower end cap from a cassette as it is forced off the lower end of the cassette body C being held fast in the cassette body-retaining block 27. A spool S is shown attached to the spool-bearing lower end portion 7 of the plunger 6.

To use the apparatus shown in FIG. 7, the lid is first unscrewed from the body 26 and the spool removed for the plunger 6. A cassette loaded with exposed photographic film is attached to the shaft portion 7 of the plunger 6 and the cassette is then inserted in the cassette body-retaining block 27.

The slidable member 14 is slid to the closed position shown in FIG. 3 so that the cap 13 cannot rotate on the lid 1. The internal threading 25 of the lid 1 is then brought into engagement with the external threading 23 on the columnar casing 26, whereby the entire apparatus is rendered light tight.

The lid 1 is then screwed down onto the casing 26. The plunger 6 is lowered as the screwing motion is continued and forces off the lowermost end cap on the cassette body C. Further screwing action forces the film on the spool into the liquid container 28 as the lower region 24 of the external threading 23 on the body 26 becomes engaged by the internal threading 25 of the lid 1.

The apparatus is stood in the beaker 32 which contains processing liquid. The liquid enters the container 28 until it reaches the same level as the top of the film in this container. Agitation of this liquid over the surface of the film is achieved by sliding the member 14 outward from the cap 13. The cap may be rotated by the member 14 in either direction. This rotation causes the plunger with the spool having the film coiled on it also to rotate. This rotation causes agitation of the processing liquid over the surface of the film.

Best results are obtained by rotating the member 14 for a number of times in one direction followed by rotation for a number of times in the opposite direction until the required processing time has elapsed.

We claim:

1. A processing device which comprises a lid; plunger means being mounted in said lid in a manner such as to be, selectively, rotatable in either direction relative to said lid, or to be locked stationary in the lid; and plunger-actuating means comprising a cap adapted to fit said lid, cap-securing means for securing said cap to said lid, said cap being associated with said plunger means for rotation therewith, a slidable member mounted on said cap slidable between a closed and an extended position, at least one abutment member mounted on said lid, and detent means comprising at least one detent member mounted on the underside of said slidable member so that, in said extended position of the slidable member, said cap is able to rotate on said lid, while, in said closed position of the slidable member, said detent means thereon act with said at least one abutment member on said lid to prevent the cap from rotating on the lid.

2. The device of claim 1, wherein in said closed position the slidable member fits into the cap so as to appear to be part of the cap.

3. The device of claim 1, wherein in the extended position said slidable member is slid partially out from said cap and acts as a handle by use of which the cap can be rotated on the lid in either direction.

4. The device of claim 3, further comprising a handling knob being present on an upper face of said slidable member.

5. The device of claim 1, wherein four members two of which are detent members are mounted on the underside of said slidable member and said cap has four grooves in which said four members on said slidable member slide thereby securing said slidable member to said cap.

6. The device of claim 5, wherein said lid has at least two projecting members axially upwardly projecting therefrom and having a gap therebetween, and when said slidable member is in the closed position, said detent members are positioned in said gap, thereby preventing rotation of the cap on the lid.

7. The device of claim 6, wherein said lid has four upwardly projecting members and said cap fits over said four upwardly projecting members so as to secure said cap to said lid.

* * * * *